US005259013A

United States Patent [19]

Kuriyama et al.

[11] Patent Number: 5,259,013

[45] Date of Patent: Nov. 2, 1993

[54] HARD X-RAY MAGNIFICATION APPARATUS AND METHOD WITH SUBMICROMETER SPATIAL RESOLUTION OF IMAGES IN MORE THAN ONE DIMENSION

[75] Inventors: Masao Kuriyama, Gaithersburg; Ronald C. Dobbyn, Ellicott City, both of Md.; Richard D. Spal, Middle Island, N.Y.

[73] Assignee: The United States of America as represented by the Secretary of Commerce, Washington, D.C.

[21] Appl. No.: 808,850

[22] Filed: Dec. 17, 1991

[51] Int. Cl.[5] ..... G21K 7/00

[52] U.S. Cl. ..... 378/43; 378/85

[58] Field of Search ..... 378/43, 84, 85

[56] References Cited

U.S. PATENT DOCUMENTS

| | | | |
|---|---|---|---|
| Re. 32,779 | 11/1988 | Kruger . | |
| 2,557,662 | 7/1951 | Kirkpatrick | 378/43 |
| 2,559,972 | 7/1951 | Kirkpatrick | 378/43 |
| 4,635,197 | 1/1987 | Vinegar et al. . | |
| 4,672,651 | 6/1987 | Horiba et al. . | |
| 4,995,062 | 2/1991 | Schulze-Ganzlin et al. . | |
| 5,008,908 | 4/1991 | Jach et al. . | |
| 5,012,498 | 4/1991 | Cuzin et al. . | |

OTHER PUBLICATIONS

Paper entitled "Improvement of Spatial Resolution of Monochromatic X-ray CT Using Synchrotron Radiation", Japanese Journal of Applied Physics, vol. 27, No. 1, Jan. 1988, pp. 127-132, Sakamoto et al.

Paper entitled "Hard X-ray Microscope with Submicrometer Spatial Resolution", Journal of Research of the National Institute of Standards and Technology, vol. 95, No. 5, Sep.-Oct. 1990, Kuriyama et al.

Paper entitled "High Resolution Hard X-ray Microscope", The Rigaku Journal, vol. 7, No. 2, 1990, pp. 5-15, Kuriyama et al.

*Primary Examiner*—Craig E. Church

*Attorney, Agent, or Firm*—Michael S. Gzybowski

[57] ABSTRACT

An apparatus and a method are provided for employing hard monochromatic x-rays to generate high resolution, dimensionally altered undistorted images of either the internal structure or surface feature details of a specimen at the submicron level in up to three-dimensions. A monochromatic hard x-ray beam is applied to the specimen and thereafter is directed to arrive at a small angle of incidence at a preferably flat, optically polished surface of a nearly perfect crystal, to be diffracted at the surface thereof to carry a first one-dimensional alteration of the image of the observed structure of the specimen. This x-ray beam is then directed, at a small angle of incidence, to the surface of a second nearly perfect crystal, the receiving surface being oriented orthogonal to the surface of the first nearly perfect crystal, to generate a further diffracted beam containing an undistorted two-dimensionally altered inverted image of the specimen with micrometer spatial resolution. The "magnification factor" of the same set of highly-perfect crystals can be varied by zooming by changing the x-ray energy of the incident beam. This last beam is received on a CCD array for direct conversion of x-ray photons into electrical charges and storage and processing of the resultant data in digitized form. By a small controlled rotation to the specimen relative to the apparatus, additional two-dimensional data are obtained and may be processed to generate high resolution three-dimensional images of the specimen structure.

12 Claims, 3 Drawing Sheets

HARD X-RAY MAGNIFICATION APPARATUS AND METHOD WITH SUBMICROMETER SPATIAL RESOLUTION OF IMAGES IN MORE THAN ONE DIMENSION

FIELD OF INVENTION

This invention relates to apparatus and a method for using hard x-rays to obtain high resolution alteration of observed image dimensions (magnification or reduction) and, more particularly, to an apparatus and method for providing alteration of image dimensions in up to three dimensions employing asymmetric x-ray diffraction from flat, optically polished surfaces of two mutually orthogonal nearly perfect crystals and direct generation of, for example, magnified images by an x-ray sensitive CCD detector or direct generation of precisely reduced undistorted image patterns onto materials such as photo-resists on substrates.

BACKGROUND OF THE PRIOR ART

There are many scientific and engineering activities which require highly detailed and precise information concerning specific materials. These include: fabrication of novel microelectronic and photonic device materials designed on the atomic scale; rapid solidification of metals to obtain unusual strength, ductility and corrosion resistance; and production of improved ceramics and composite materials which typically are highly vulnerable to thermal and mechanical problems during processing.

In these and other comparable activities, it is often essential to examine a specimen of a selected material at very high resolution, e.g. to detect lines of less than 1 micrometer width and/or to resolve lines as little as 1.2 micrometer apart. Such high resolution requires advances in the state of the art of x-ray imaging, as practiced in the techniques of radiography, tomography, and diffraction topography. Also, in many applications, including microcardiography and high resolution tomography, it is highly desirable to obtain three-dimensional imaging of the specimens.

In fact, x-ray microtomography is a rapidly developing field for the detection of flaws and defects inside materials produced for industrial applications. For example, the structure of all materials as they are formed is often locally non-uniform over regions of the order of 1 micrometer. Inhomogeneities occurring in diffusion layers and grain boundaries, local compositional variations, regionally homogeneous strains (residual stresses) and inhomogeneous strains, etc., often alter the behavior of materials from their originally designed characteristics.

Successful fabrication of tailored materials having structures not found in nature depends entirely on minute structural details and their influence on the properties and performance of the object fabricated therefrom. Similarly, in microelectronic devices, where different atoms are doped in mutually coherent layers, the thickness and shape of doped layers may change and may cause degradation of functional properties intended to be obtained by the designer. What is needed in such instances is a measurement technique to "see" what happens locally, and to pinpoint local events of significance with high spatial resolution. It is to such needs that the present invention is directed. The invention magnifies, in one or two dimensions, parallel projection monochromatic x-ray images. Such images are obtained, for example, by the techniques of radiography, tomography, and diffraction topography, when the specimen is irradiated with well collimated monochromatic x-rays.

It should be understood that other materials, such as tissue samples from living beings and plants, also may be studied advantageously by high resolution viewing and adequate magnification to clarify significant details, e.g., the presence of abnormal cells or the like.

What is needed, therefore, are apparatus and methods for significantly magnifying a view that is originally generated by the passage of short wave-length hard x-rays through a thin specimen of a selected material. For certain applications, using the same apparatus and method with obvious changes, the x-rays are reflected off a selected surface of a specimen to study its local topography with very high resolution. It is to such needs that the present invention is directed. The invention magnifies, in one or two dimensions, parallel projection monochromatic x-ray images. Such images are obtained, for example, by the techniques of radiography, tomography, and diffraction topography, when the specimen is irradiated with well collimated monochromatic x-rays.

A paper titled "Improvement of Spatial Resolution of Monochromatic X-ray CT Using Synchrotron Radiation" by Sakamoto et al., Japanese Journal of Applied Physics, Volume 27, No. 1, January 1988, pp. 127–132, discloses an x-ray computer tomography technique using synchrotron radiation (SR) as an x-ray source to generate CT images of improved quality. A method is disclosed for improving the spatial resolution, involving the one-dimensional magnification of projection images using asymmetric diffraction. The disclosed method employs a scintillator covering the detector surface. The best spatial resolution obtained was about 15 to 20 micrometers, using a magnification factor of 9.0. The dispersal of visible light, generated by x-rays, in the scintillator appeared to degrade significantly the spatial resolution, as stated on page 130 of the same paper.

There are numerous devices and systems known and commercially available for generating magnified images of very fine details in material samples.

U.S. Pat. No. 4,672,651, to Horiba et al., discloses apparatus and a method in which respective cone-like beams of x-rays are projected from two different directions through a person's body, and the transmitted x-rays are analyzed to generate a projection image. A contrast medium is initially injected into the body to reach a part of the body which is of interest. A direct x-ray detector is used which can also convert a received signal into an optical image which can be directed into a TV camera.

U.S. Pat. No. 4,635,197, to Vinegar et al., discloses a high-resolution tomographic imaging method, wherein a sample is scanned at many points in corresponding cross-sections which are separated by a distance less than the width of an x-ray beam of a CAT scanner. The measured density function thus obtained is deconvolved, with the beam width function for the CAT for each of the plurality of points, to thereby obtain the actual density function for the plurality of points. This information is directly used to generate an image of a sample which has a spatial resolution in the axial direction that is smaller than the width of the x-ray beam of the CAT.

U.S. Pat. No. 5,012,498, to Cuzin et al., discloses an x-ray tomography device which enables the generation of an image at a plane identified transversely through an object. It comprises an x-ray source which supplies high energy pulses which traverse the object. Both the source of the x-rays and the detector are stationary, and the object is rotated.

U.S. Pat. No. Re. 32,779, to Kruger, discloses a radiographic system employing multi-linear arrays of electronic radiation detectors of the CCD type. An x-ray source provides a diverging x-ray beam which passes through portions of a human body to be received first through an image intensifier and then passed through a lens or other focusing device. The transmitted-radiation is focused upon a multi-linear array which comprises a two-dimensional CCD detector.

There clearly exists a need for a high resolution, one-, two- or three-dimensional magnification system and corresponding methods which permit magnifications of up to 200 times the original at resolutions enabling study of features less than 1 micrometer in size and for separation of adjacent features at close to the 1 micrometer level of precision.

The present invention, as described more fully hereinafter, is believed to answer this need. Persons of ordinary skill in the art, upon understanding the present disclosure, are expected to consider obvious modifications of both the apparatus and the method disclosed herein. Such modifications and variations are intended to be comprehended within the scope of the invention described below in detail

SUMMARY OF THE INVENTION

Accordingly, it is a principal object of this invention to provide an apparatus for generating a highly magnified or demagnified image of fine structural details, at the micrometer or submicrometer level of resolution, within or on the surface of a specimen, by asymmetric dynamical x-ray diffraction. Because of the reciprocity theorem applicable to x-ray optics, the term "magnification" also implies the shrinkage of an image, that is "demagnification". This is so well known that this implication will not, hereafter, be mentioned explicitly.

It is a further object of this invention to provide an apparatus and a method for generating highly magnified images of structural details at the micrometer level within or at the surface of a specimen, by asymmetric dynamical x-ray diffraction, preferably from a flat optically polished surface of a nearly-perfect crystal, using a monochromatic hard x-ray beam.

It is an even further object of this invention to provide two-dimensional highly-magnified images of structural details at the micronmeter level in or at the surface of a specimen, by employing a parallel, hard, monochromatic x-ray beam, asymmetrically diffracting the same from optically flat polished surfaces of two nearly perfect crystals placed orthogonally to each other and directly converting the x-ray photons to electrical charges, without prior conversion to optical photons, to generate a high resolution two-dimensional and recordable magnified image.

It is another related further object of this invention to provide apparatus and a method for x-ray phase contrast microscopy, in which the two-dimensionally magnified high resolution images of strain fields around flaws and defects in materials are generated in addition to the normal shape images of these flaws and defects, particularly when the initial x-ray beam containing the image of structural details is obtained from specimen materials under Bragg diffraction conditions.

It is also a related further object of this invention to provide apparatus and a method for generating a three-dimensional, highly-magnified, high-resolution image of structural details of a specimen, using a parallel beam of hard, monochromatic, x-rays and direct conversion of information-bearing x-ray photons to visible photons.

These and other related objects are realized by providing an apparatus comprising:

means for applying a parallel first x-ray beam of predetermined energy and brilliance to a portion of the specimen, to thereby generate a parallel second x-ray beam which contains an initial image relating to the specimen;

a first nearly perfect crystal formed to provide a first diffraction surface oriented to receive said second x-ray beam at a first angle of incidence to dynamically diffract the same and to thereby generate a parallel third x-ray beam containing a first one-dimensional magnification of said initial image, said third x-ray beam being reflected with respect to said first diffraction surface at a first angle of reflectance relative thereto; and x-ray sensitive detector means for receiving said third x-ray beam and directly generating therefrom an output corresponding to a first magnified image;

monochromator means for monochromatizing said first x-ray beam prior to application thereof to said specimen;

In another aspect of the invention, there is provided a system for obtaining a two-dimensionally altered high-resolution image of a specimen, comprising:

means for applying a parallel first x-ray beam of predetermined energy and brilliance to a portion of the specimen, to thereby generate a parallel second x-ray beam which contains an initial image relating to the specimen;

a first nearly perfect crystal formed to provide a first diffraction surface oriented to receive said second x-ray beam at a first angle of incidence to dynamically diffract the same and to thereby generate a parallel third x-ray beam containing a first one-dimensional alteration of said initial image; said third x-ray beam being reflected with respect to said first diffraction surface at a first angle of reflectance relative thereto;

a second nearly perfect crystal, similar to the first nearly perfect crystal, formed to provide a second diffraction surface oriented orthogonally with respect to said first diffraction surface and disposed to receive said third x-ray beam at a second angle of incidence to dynamically diffract the same and to reflect a parallel fourth x-ray beam containing a second one-dimensional alteration of said first dimensional alteration to the same degree, but orthogonally directed to said first dimensional alteration, the combined effect of both one-dimensional alterations being an undistorted two-dimensional alteration of said initial image, said fourth x-ray beam being reflected with respect to said second diffraction surface at a second angle of reflectance relative thereto; and x-ray sensitive detector means for receiving said fourth x-ray beam and directly generating therefrom an output corresponding to a two-dimensional second magnified image.

In yet another aspect of this invention, there is provided a system for generating a three-dimensionally magnified high-resolution image of a specimen, comprising:

means for applying a parallel first x-ray beam of predetermined energy and brilliance to a portion of the specimen, to thereby generate a parallel second x-ray beam which contains an initial image relating to the specimen;

a first highly perfect crystal formed to provide a first diffraction surface oriented to receive said second x-ray beam at a first angle of incidence to dynamically diffract the same and to thereby generate a parallel third x-ray beam containing a first magnification of said initial image, said third x-ray beam being reflected with respect to said first diffraction surface at a first angle of reflectance relative thereto;

a second nearly perfect crystal, similar to the first nearly perfect crystal, formed to provide a second diffraction surface oriented orthogonally with respect to said first diffraction surface and disposed to receive said third x-ray beam at a second angle of incidence to dynamically diffract the same and to reflect a parallel fourth x-ray beam containing a second one-dimensional alteration of said first one-dimensional alteration to the same degree, but orthogonally directed to said first one-dimensional alteration, the combined effect of both one-dimensional alterations being an undistorted two-dimensional alteration of said initial image, said fourth x-ray beam being reflected with respect to said second diffraction surface at a second angle of reflectance relative thereto;

x-ray sensitive detector means for receiving said fourth x-ray beam and directly generating therefrom an output corresponding to a two-dimensional second magnified image;

monochromator means for monochromatizing said first x-ray beam prior to application thereof to said specimen;

disposition adjustment means for providing fine adjustments to the dispositions of said specimen relative to said first nearly perfect crystal, of said first nearly perfect crystal with respect to said second highly perfect crystal, and of said second highly perfect crystal relative to said detector means;

computer means for controlling said adjustment means;

means for rotating said specimen through a predetermined angle; and means for digitizing and processing data generated by said detector means in relation to a rotation of said specimen to develop a three-dimensionally magnified image of said specimen.

In another related aspect of this invention, there is provided a method for directly generating a two- or three-dimensionally magnified high-resolution image of a specimen, comprising the steps of:

applying a parallel first x-ray beam of predetermined energy and brilliance to a portion of the specimen to generate a parallel second x-ray beam which contains an initial image relating to the specimen;

positioning a first highly-perfect crystal to orient a first diffraction surface thereof to receive said second x-ray beam at a first angle of incidence to dynamically diffract the same to generate a parallel third x-ray beam containing a first magnification of said initial image and reflecting said third x-ray beam with respect to said first diffraction surface and a first angle of reflectance relative thereto;

disposing a second highly-perfect crystal to orient a second diffraction surface thereof orthogonally with respect to said first diffraction surface, said second diffraction surface being disposed to receive said third x-ray beam at a second angle of incidence to dynamically diffract the same and to reflect a parallel fourth x-ray beam containing a second magnification of said first magnification in a direction orthogonal to a direction of said first magnification, said fourth x-ray beam being reflected with respect to said second diffraction surface at a second angle of reflectance relative thereto; and receiving said fourth x-ray beam at an x-ray sensitive direct detecting means for generating therefrom an output corresponding to a two-dimensional second magnified image.

DETAILED DESCRIPTION OF THE PREFERRED EMBODIMENTS

The basic concept underlying the present invention is to obtain two-dimensional x-ray image magnification by means of x-ray dynamical diffraction at each of two mutually orthogonally disposed nearly perfect crystals, without any intermediate conversion of the x-ray photons to visible photons. The aim is to thus obtain submicrometer resolution of a quality suitable for microtomography. The x-rays utilized for this purpose are preferably 5 to 30 keV.

Furthermore, three-dimensional magnified images are generated from the two-dimensional magnified images, without scanning, simply by a controlled, very small, rotation of the object being viewed. A dimensional images is obtained as the specimen is rotated through an incremental angle of less than 1° and provides the basic image data sets for three-dimensional tomographic reconstruction with the desired 1 micrometer resolution.

Because of the high x-ray photon flux levels required for the desired high resolution magnification, a high brilliance x-ray source is needed. A suitable source is a synchrotron, although high power rotating anode x-ray generators may also be used. The latter source may have a smaller source size than 0.2 mm and can therefore be positioned proportionately closer to the object being irradiated thereby, but the x-ray beam provided thereby is not as powerful as that obtainable from a synchrotron.

Optimum performance according to this invention is achieved when the x-ray input beam incident on the specimen is well collimated and monochromatic. Collimation is accomplished by minimizing the source size and locating the specimen sufficiently far from the source. Monochromitization is accomplished by a double flat crystal monochromator located before the specimen. The incident beam is parallel to within 50 seconds of arc in one dimension and the image is generated by matched asymmetric or symmetric diffraction elements operating as a prism-monochromator system. This method also enables x-ray phase contrast microscopy, with submicrometer resolution, when an object image is produced by x-ray diffraction.

The key to obtaining the required high spatial resolution in the present invention, as described more fully hereinbelow, involves preparation of the incident original x-ray beam prior to its application to a specimen or object, controlling the location of the specimen rotational axis with a precision of 0.1 micrometer or better, and receiving the x-ray beam containing the finally magnified image directly at an x-ray detector, capable of micrometer or submicrometer resolution. The improvement thus obtained may be assessed by considering that the best resolution claimed to date from known devices is 250 line pairs per mm or somewhat better, whereas the present invention enables resolution to 417 line pairs per mm.

Figure 1:
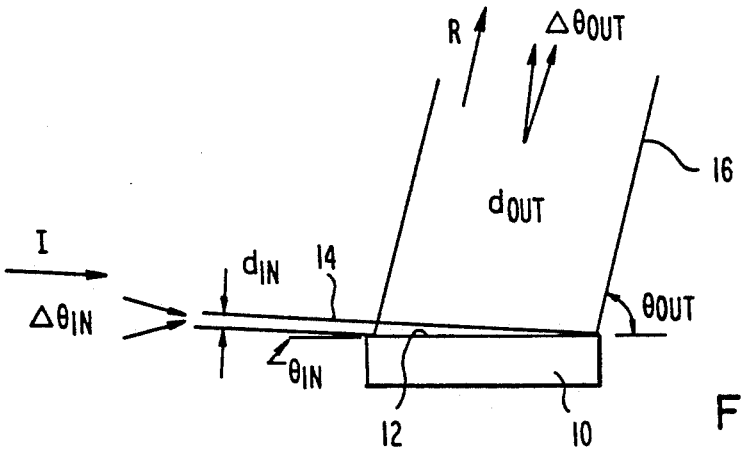
FIG. 1 is a schematic figure to explain coplanar asymmetric Bragg diffraction to produce one-dimensional magnification of an incident parallel x-ray beam.

FIG. 1 is a side elevation view of a nearly perfect crystal 10 preferably having a flat, optically polished face 12 to which is applied an incident hard x-ray beam 14 in a direction indicated by the arrow "I". The width of the incident x-ray beam 14 is "$d_{in}$" and its divergence prior to reaching surface 12 is "$\Delta\Theta_{in}$". Incident x-ray beam 14, which is sought to be made parallel to the extent possible, is incident on face 12 at an incident angle "$\Theta_{in}$".

At the surface 12 of the highly-perfect crystal 10, in a manner well known to persons of ordinary skill in the art, the incident x-ray beam 14 undergoes an asymmetric dynamical diffraction and is "reflected" in the direction indicated by the arrow "R" as a "reflected beam" 16, which due to the nature of the Bragg diffraction contains a one-dimensionally enlarged form of incident beam 14. The brilliance of reflected beam 16 is inversely proportional to the magnification, and the direction of reflected beam 16 with respect to face 12 is given by the angle "$\Theta_{out}$". The enlarged dimension of reflected beam 16 is "$d_{out}$", and the divergence of reflected beam 16 is "$\Delta\Theta_{out}$". Preferably, incident x-ray beam 14 is either monochromatic to start with or is rendered monochromatic by passage through a monochromator (not shown) of any known type.

There are three aspects of asymmetric diffraction which are important for image magnification, namely: beam magnification; reflectivity and the surface; and the beam acceptance angle of the crystal for the desired "reflection".

With reference to FIG. 1 and the symbols used therein, within the plane of diffraction the one-dimensional magnification is characterized by a factor "m", which is given by:

$$m = d_{out}/d_{in} = \sin\Theta_{out}/\sin\Theta_{in}, \quad (1)$$

where $\Theta_{in}$ and $\Theta_{out}$ are the angles between the crystal surface and the incident and reflected beams, respectively. Per equation (1) above, high magnifications are obtained when $\Theta_{in}$ is very small.

If crystal 10 is properly oriented with respect to incident beam 14, in a manner well known to persons of ordinary skill in the art, incident beam 14 is diffracted in the direction D as the diffracted beam 16. The width of diffracted beam 16 is "$d_{out}$", and its angle with respect to surface 12 is "$\Theta_{out}$".

Note that the plane containing beams 14 and 16, called the "plane of diffraction", is perpendicular to surface 12. This situation is called "coplanar diffraction", because the incident beam 14, the diffracted beam 16, and the normal to surface 12 lie in the same plane. If they did not lie in the same plane, the situation would be called "skew diffraction". While skew diffraction could conceivably be used in an embodiment of the invention, coplanar diffraction is preferred for its simplicity, and is henceforth assumed.

Note that $\theta_{out}$ does not equal $\theta_{in}$, unlike the more familiar case of specular reflection of light from a mirror. This situation is called "asymmetric diffraction". Perpendicular to the plane of diffraction, no enlargement occurs. Thus, the magnification is one-dimensional. This can be achieved by increasing the energy of the incident x-rays.

Practically achievable levels of magnification in this manner range between 10 and 200 for a single magnification in one dimension. As in the case of systems employing visible light microscopy and electron microscopy, one can effectively utilize the above-described asymmetric diffraction elements in series, as a complex lens, to achieve higher levels of magnification in a single dimension. In principle, it would involve duplication of the mechanism illustrated in FIG. 1 in rather obvious manner, hence this application of the basic form of the present invention is not further discussed or illustrated specifically.

In experiments, magnification factors of more than 100 have bee achieved. The magnification factor may be continuously adjusted over a wide range by varying the energy of the incident beam. In a typical example, the magnification factor is adjusted from 20 to 80 by varying the energy from 11.4 to 12.3 keV.

What is important to appreciate is that, in dynamical diffraction as employed here, a parallel beam of monochromatic x-rays which strikes a crystal at an angle slightly different from the Bragg condition can experience diffraction to generate the magnified one-dimensional image. For reference purposes, the ratio of the diffracted total flux, in photons/sec, to the incident total flux is called the "reflectivity", and is a function of the deviation from the Bragg condition. For a thick perfect crystal, with no absorption, this ratio is 1 for a range of angles centered about the Bragg condition (also called the "rocking curve width" or "range of reflection"), and falls rapidly to 0 for larger deviations from the Bragg condition. This angular range of reflection thus gives the "beam acceptance angle" of the crystal for the desired reflection. Because the reflectivity for a silicon (or any perfect) crystal is very close to unity, i.e., approximately 0.8 to 0.9, regardless of the diffracting plane, the intensity or brilliance (in photons/sec. $cm^2$), of a parallel incident x-ray beam magnified in one dimension by asymmetric diffraction from a perfect crystal is decreased by a factor $m^{-1}$ only because of the magnification of the beam area.

In dynamical diffraction from a perfect crystal, an incoming parallel beam is diffracted into a parallel beam. Since the Bragg law is "loosened" to restrict photon momentum conservation only in two dimensions, unlike the Bragg law for kinematical scattering which is equivalent to the photon momentum conservation law in three dimensions, the total divergence of outgoing beams, $\Delta\Theta_{out}$, becomes:

$$\Delta\Theta_{out}=m^{-1}\Delta\Theta_{in} \quad (2)$$

In practice, the incident x-ray beam has a small finite angular divergence $\Delta\Theta_{in}$, mostly due to the size of the x-ray source. Therefore, for imaging purposes, it is the source size rather than the beam divergence that becomes important. The higher the magnification obtained, the more parallel becomes the outgoing beam. The small value of $\Delta\Theta_{out}$ therefore guarantees one-to-one correspondence of the magnified image with the unmagnified or original image. This is an essential factor for providing a device that functions as a "magnifying lens".

When the x-ray energy of incident monochromatic beams is tuned to any desired value, per equation (1) above, the magnification factor of the same crystal can be varied at will, thus providing an image-zooming capability which lends itself to many useful applications in practice.

Figure 2:
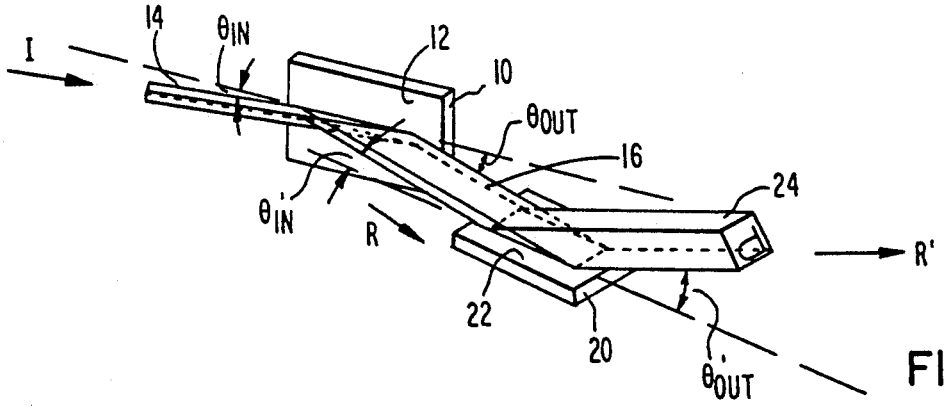
FIG. 2 is a schematic perspective view to illustrate the geometry of two coplanar asymmetric diffractions, in orthogonal planes, at two nearly perfect crystals having to obtain an undistorted two-dimensional magnification of an image contained in an x-ray beam that has been applied to a specimen.

For two-dimensional imaging, two one-dimensional magnifying nearly perfect crystals are arranged with their planes of diffraction orthogonal to each other, to obtain an undistorted, albeit inverted, image of the specimen. Thus, in FIG. 2, the exemplary specimen 70 sought to be magnified in two dimensions is a very small letter "P" at the extreme left. An incident parallel hard monochromatic x-ray beam 14 containing an unmagnified image thereof impinges at a small first incident angle $\Theta_{in}$ with respect to a plane face 12 of a first nearly-perfect crystal 10. The beam is then diffracted at the surface 12 (as described above) and is reflected from surface 12 at an angle $\Theta_{out}$ as first diffracted/reflected beam 16 along the direction of arrow R. A second nearly-perfect crystal 20 comparable to nearly perfect crystal 10, having a plane face 22 placed to be orthogonal to face 12 to provide a second diffraction surface thereat, receives the once-diffracted beam 16 at an incident angle $\Theta'_{in}$. Beam 16 now serves as the incident beam for the second crystal 20 and is dynamically diffracted at surface 22, and is reflected at an angle $\Theta'_{out}$ with respect to face 22 as twice-diffracted beam 24 along the direction of arrow "R'". As schematically illustrated in FIG. 2, the magnified image of the exemplary object or specimen "P" is enlarged in two dimensions mutually orthogonal directions and is inverted. This discussion, and FIG. 2, taken together, should serve to explain the basic physical principle sought to be employed in the present invention.

Elements of the actual mechanism, per a preferred embodiment of the invention, will now be described in detail, together with a discussion of the steps to be employed in practicing the invention.

As previously noted, if a synchrotron is utilized as the source of the initial x-ray beam, it is typically located approximately 20 meters away from the first nearly-perfect crystal, e.g., 10, and the first incident angle $\Theta_{in}$ is approximately twice the value of the critical angle for total reflection for the material of the crystal, typically several tenths of a degree. For silicon, this is approximately 0.25°. In a prototype device according to the preferred embodiment described herein, pure silicon crystals were used and were 3.5 cm long, 1 cm wide and 0.5 cm thick. Pure germanium is believed to have a better beam acceptance angle and it can be more tolerable with x-ray beams of very high intensity than silicon, and hence the "crystals" may be made of pure germanium.

Figure 3:
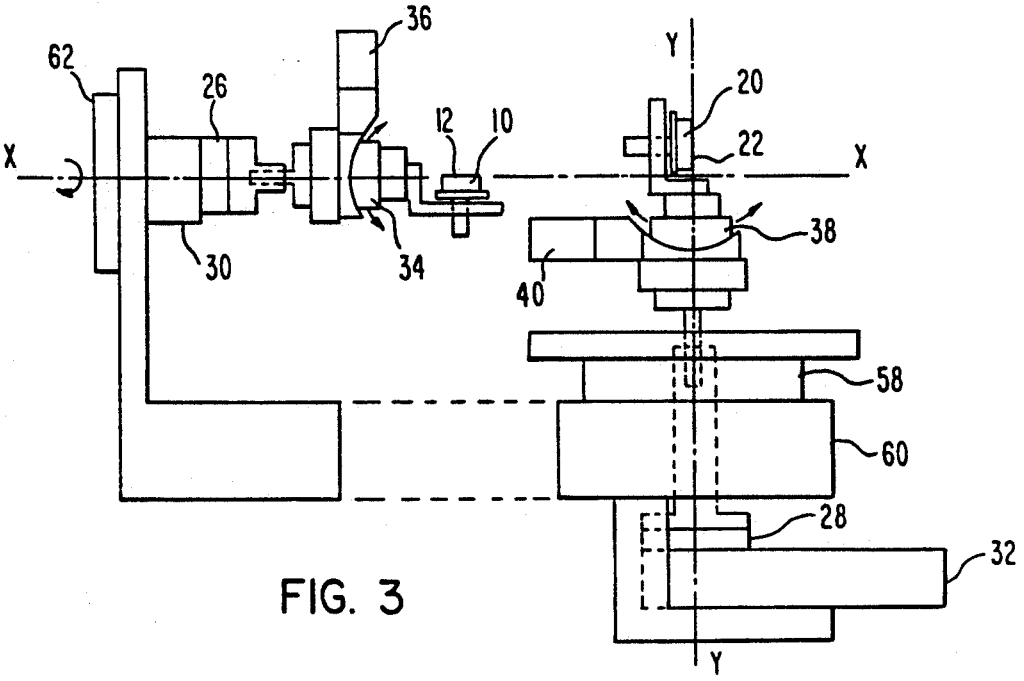
FIG. 3 is a side elevation view of an apparatus according to a preferred embodiment of this invention.
Figure 5:
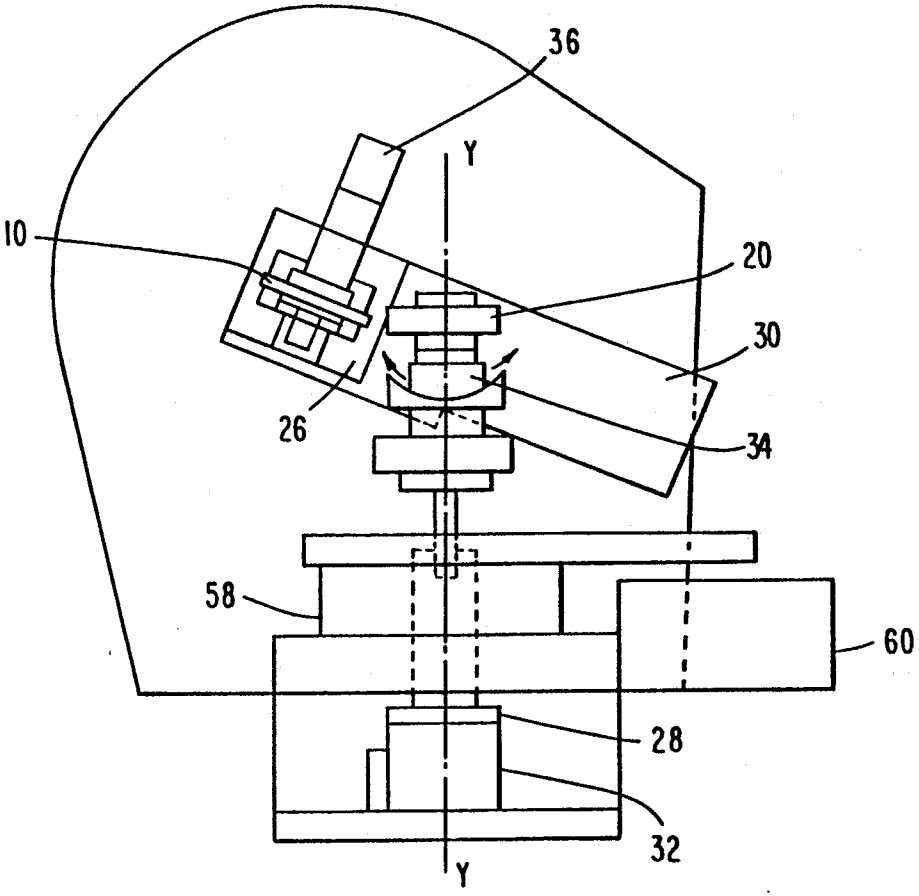
FIG. 5 is a side elevation view of a portion of the apparatus per FIG. 1, with the detector omitted.

FIG. 3 is a side elevation view of a preferred embodiment of the apparatus according to this invention. (Note that the plane of diffraction of crystal 10 is horizontal in FIG. 2, but vertical in FIG. 3). In it, there are mounted a first nearly perfect crystal 10 and a second nearly perfect crystal 20, respectively. Each of these crystals is mounted to be respectively rotatable about mutually orthogonal axes X—X and Y—Y, respectively, on rotator elements 26 and 28. Rotator elements 26 and 28 are preferably driven by respective stepper motors 30 and 32, which can be controllably rotated in steps of 0.6 arcseconds per step. Such stepper motors are readily available commercially from a variety of sources, and the desired resolution may be obtained by microstepping the stepper motor.

What is important to note is that the respective axes of rotation, i.e., X—X and Y—Y, are perpendicular to the respective planes of diffraction per surfaces 12 and 22 of nearly perfect crystals 10 and 20 respectively. Consequently, even as planes 12 and 22 are rotated about axes X—X and Y—Y respectively, the planes 12 and 22 remain mutually orthogonal. This perpendicularity is enforced by adjusting the arcs on goniometer heads 34 and 38, driven by dc motors 36 and 40, respectively. Thus, rotator elements 26 and 28 adjust $\theta_{in}$ and $\theta_{in}$, respectively.

In addition to the above-described rotational disposition adjustment means, i.e., the rotators, stepper motors, goniometer heads and the like, the mechanism supporting crystal 10 includes a goniometer 34 driven by a motor 36, and the mechanism supporting crystal 20 includes a goniometer 38 driven by a motor 40. Clearly, by such known precisely adjustable means, very fine positional adjustments, combining elements of translation and rotation, may be obtained and precisely controlled by microprocessor or computer means 78 (FIG. 7) in conventional manner. By such means, therefore, a hard x-ray beam generated by a source such as a synchrotron, after passage through a monochromator (not shown), can be applied to generate a twice diffracted x-ray beam 24 (see FIG. 2) finally diffracted off face 22 to carry an image magnified in two dimensions.

This twice-diffracted beam 24 is directed to an x-ray sensitive CCD array which is located inside a camera head 42 of a commercially available camera system such as one sold by Photometrics, Ltd., of Tucson, Ariz., which includes a CH220 TEC/liquid cooled camera head with a beryllium window and a PM 510 CCD. This is schematically best seen in FIG. 4 and the camera head is mounted to be rotatable about axis Y—Y. The CCD array (not explicitly shown) is positioned behind the thin beryllium window 44, which serves to keep out ambient visible light, but which allows passage of the x-ray beam 24 carrying the two-dimensional magnified image.

A carousel 46 is mounted on the CCD camera head 42 to hold a PIN photodiode 48 to be used for correct alignment of crystals 10 and 20 during use of the apparatus. The PIN photodiode 48 is covered by an aluminum foil window (not shown), to keep out visible ambient light and, preferably, has an active area of $4\times4$ mm$^2$. Carousel 46 also has an aperture 50 to allow passage therethrough of the magnified image-carrying x-ray beam 24 to the CCD array of the detector. A stepper motor 52 is provided to position the carousel rotationally about an axis of rotation 54, so that either the aperture 50 or the PIN photodiode 48 can be selectively disposed to receive the x-ray beam 24. Control over positioning by such operation of carousel 46 is exercised by operation of a microprocessor or computer 56, best seen in FIG. 7. A shutter (not shown), is provided for controlling the image exposure, i.e., the time for which the CCD array is exposed to the x-ray beam carrying the twice-magnified image of the specimen. This shutter is separately disposed in front of the specimen and it too is controlled by the CCD camera computer 56.

Figure 4:
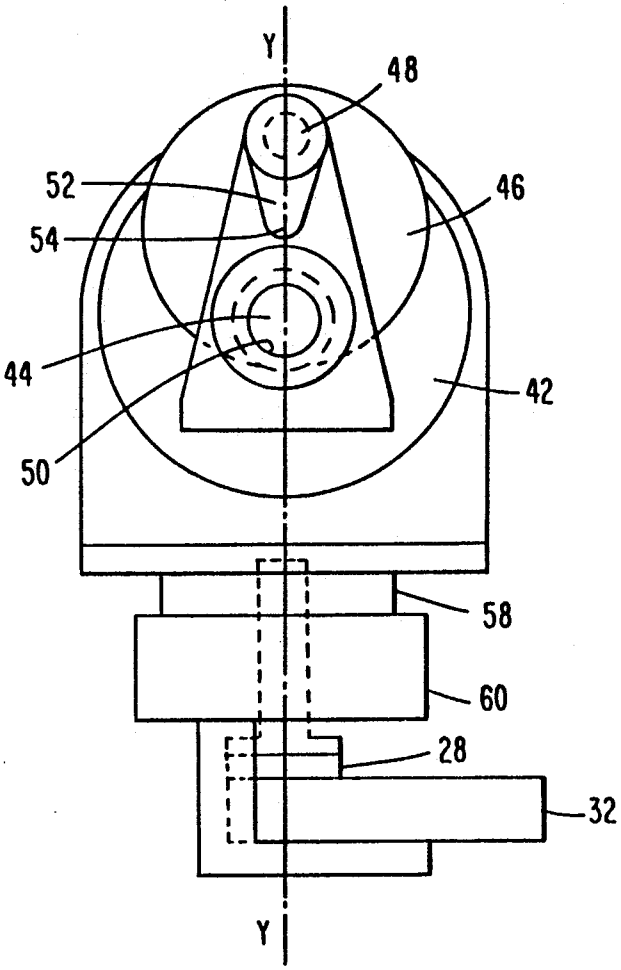
FIG. 4 is an end elevation view of a portion of the apparatus per FIG. 1, with the nearly-perfect crystals omitted.

The entire assembly of the CCD camera head 42 and carousel 46 (and the elements mounted thereto), is controllably rotatable by being mounted on a rotator 58 driven by a stepper motor 60, as best seen in FIGS. 3 and 4. Therefore, by computer-controlled operation of stepper motor 60, the CCD array can be accurately disposed to receive for a predetermined period of time (by operation of the shutter, not shown), the x-ray photons in beam 24 which carries the two-dimensional magnified image of the specimen.

Figure 7:
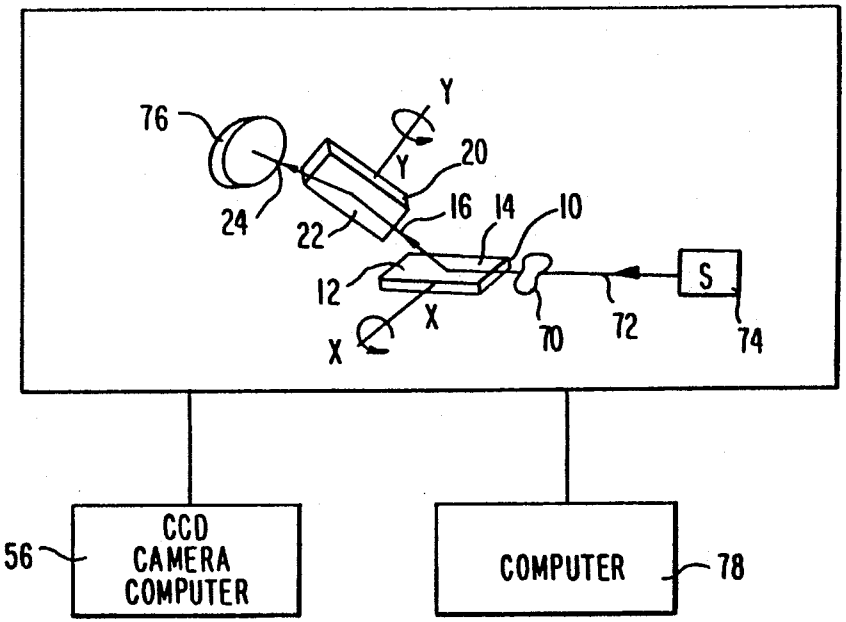
FIG. 7 is a simplified schematic block diagram of the system according to a preferred embodiment of the invention.
Figure 6:
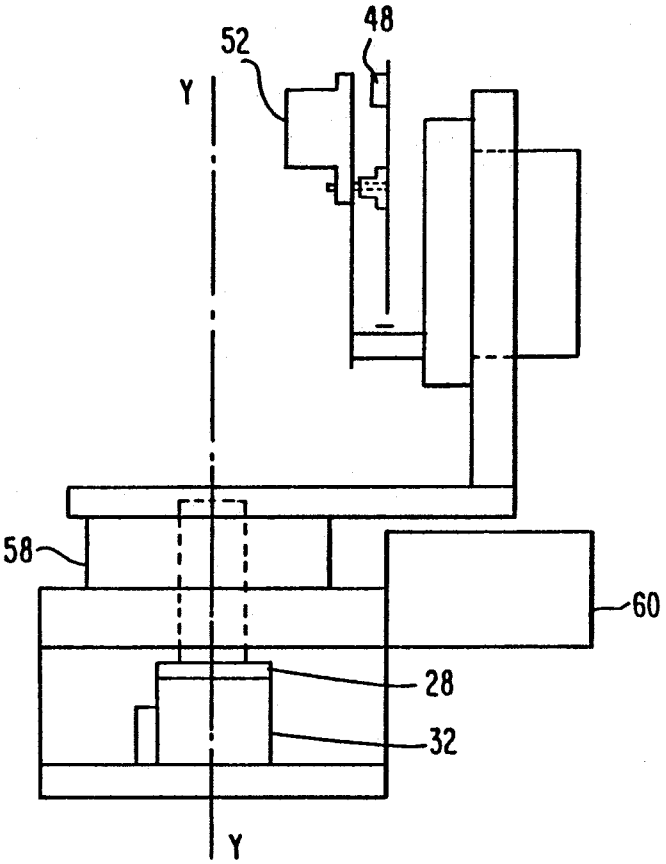
FIG. 6 is a side elevation view of a portion of the apparatus according to FIG. 1, with the crystals omitted.

The entire apparatus, as described hereinabove, is mounted on another rotator 62, best seen in FIG. 3, which has a rotation axis coincident with that of rotator 26, and can be rotated as indicated by the curved arrow at the left-hand side of FIG. 3 to precisely align the plane of diffraction with respect to the specimen and/or initially-incident beam 14 provided from an x-ray source such as a synchrotron (S in FIG. 7). It may be possible to employ a single microprocessor or computer to control the operations of all of the rotators through the various stepper motors as described. Such a computer, if selected to have the appropriate capacity and programmability, can also be utilized to read the data generated by the PIN photodiode 48 and to align the CCD array, i.e., the detector means, in accordance with the readout from PIN photodiode 48.

The crystals are preferably aligned in sequence by first adjusting rotator 62 to locate PIN photodiode 48 in the expected position of the desired diffracted beam, i.e., beam 16 for crystal 10 and beam 24 for crystal 20. Then $\theta_{in}$ or $\theta_{in}$, for crystal 10 or 20 respectively, is scanned over a wide range while the computer monitors PIN photodiode 48 to determine the angle which maximizes the diffracted beam intensity. During this operation, slits provided in the monochromator system are set just inside the magnified image of the incident x-ray beam. After a series of routine operations are thus completed, the CCD array is rotated, by operation of carousel 46, to take the place of the PIN photodiode 48. The refinement of the angles by which crystals 10 and 20 are oriented with respect to the incident x-ray beam 14 and with respect to each other follows under the observation of the image on a monitor screen (not shown) coupled to the CCD array to "tweak up" the apparatus.

In order to ensure orthogonality in the alignment of the planes of diffraction of crystals 10 and 20, a fine wire mesh is inserted in place of a specimen holder (not shown) and the dispositions of crystals 10 and 20 are adjusted by operation of goniometers heads 34 and 38, preferably under control of the computer. The operator thus views the two-dimensional image of the fine wire mesh on a monitor screen (not shown) of known type, which is coupled to the CCD array. Rows and columns of the viewed mesh image must become perpendicular to each other for correct alignment to be obtained. As persons of ordinary skill in the art will appreciate, when the magnification factor of the apparatus is increased by increasing the x-ray energy, the orthogonality of the planes of diffraction of crystals 10 and 20 must be correspondingly refined. Once this alignment is completed, the aperture 50 is positioned in front of the CCD array to view the image and to generate the desired two-dimensional magnified image for display, recordation and processing in any known manner by use of the computer.

As noted earlier, a parallel monochromatic incident x-ray beam is highly desirable. Such a beam can be prepared by a flat, asymmetrically-cut monochromator crystal with characteristic radiation and by a non-dispersive double flat crystal monochromator, with a synchrotron serving as a source of the primary x-rays. Such crystals can be prepared for symmetrical and/or asymmetrical diffraction. Calculations and experiments indicate that the asymmetric (m) and asymmetric (1/m) arrangements for these crystals give a better condition for photon flux, but that the symmetric ($m=1$) and symmetric arrangement is slightly superior with respect to spatial resolution.

The CCD array and the camera structure as a whole can be provided with digital data storage means of known type (not shown) for storage of the generated magnification data and for subsequent processing and quantitative analyses thereof.

As persons of ordinary skill in the art will appreciate, the specimen itself may be of a type of which the surface structure is of principal interest, e.g., a finely etched structure for forming a microcircuit on a substrate, or may be a fine slice of a composite material or the like of which the internal structure is to be studied. In the first of these two examples where surface structure is of importance, the incident x-ray beam 14 which reaches face 12 of the first nearly perfect crystal 10 must be obtained by diffraction in the reflection geometry from a portion of the microstructure of interest so as to avoid magnifying irrelevant information. On the other hand, where the internal structure within a thin slice of a specimen material is of interest, the thin slice of material may be positioned so that the incident x-ray beam 12 is obtained by transmission through the thin slice of material. Persons of ordinary skill in the art of microtomography and microscopy can be expected to adapt readily-available elements of components for this purpose, hence a detailed description thereof is not provided.

To use the apparatus as described, the user must employ at least the following procedural steps. First, the user must prepare and mount a specimen 70 for transmission through or diffraction off of a selected portion thereof of an initial x-ray beam 72 from a source 74, e.g., from a synchrotron after monochromatization. The user must then operate the computer 78 to control the various stepper motors and goniometers to align face 20 of first crystal 10 to receive x-ray beam 14 at a suitable angle of incidence, and ensure that the planes of diffraction of crystals 10 and 20 are orthogonal. This may be accomplished by use of the fine wire mesh as previously described to "tweak up" the system. Once the user has correctly aligned the respective elements by viewing the results of the adjustments on a monitor, the user must operate the CCD camera head and carousel to position the CCD array mounted on the detector camera head, and the shutter, to receive x-ray beam 24 containing the two-dimensional magnified image for a suitable period of time. The two-dimensional magnified image containing x-ray photons is thus received by the CCD array and is directly converted into digitized information which may be stored, displayed and/or processed as desired.

The apparatus also permits the use of an additional step, i.e., a very small rotation of the specimen 70 (by less than 1°), followed by generation and recordation of corresponding two-dimensionally enlarged images, for generation therefrom by known types of processing of these data a three-dimensional image of the specimen structure can be generated without scanning of the specimen as required in known devices. It is believed that software and the like for the necessary programming of the computer for such purposes is either available or can be readily developed by persons of ordinary skill in the art exercising conventional programming skills. The key, however, is that by the simple exercise of the additional step of slightly rotating the specimen and generating more two-dimensional magnified images, a user can obtain very high resolution, highly-magnified, three-dimensional images of the structure of a specimen, avoiding the difficulties of scanning the specimen as well as the loss of resolution incurred by the use of phosphor elements and the like.

In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A system for obtaining a two-dimensionally altered high-resolution image of a specimen, comprising:

means for applying a parallel first x-ray beam of predetermined energy and brilliance to a portion of the specimen, to thereby generate a parallel second x-ray beam which contains an initial image relating to the specimen;

a first nearly perfect crystal formed to provide a first diffraction surface oriented to receive said second x-ray beam at a first angle of incidence to dynamically diffract the same and to thereby generate a parallel third x-ray beam containing a first one-dimensional alteration of said initial image; said third x-ray beam being reflected with respect to said first diffraction surface at a first angle of reflectance relative thereto;

a second nearly perfect crystal, similar to the first nearly perfect crystal, formed to provide a second diffraction surface oriented orthogonally with respect to said first diffraction surface and disposed to receive said third x-ray beam at a second angle of incidence to dynamically diffract the same and to reflect a parallel fourth x-ray beam containing a second one-dimensional alteration of said first one-dimensional alteration to the same degree, but orthogonally directed to said first one-dimensional alteration, the combined effect of both one-dimensional alterations being an undistorted two-dimensional alteration of said initial image, said fourth x-ray beam being reflected with respect to said second diffraction surface at a second angle of reflectance relative thereto; and x-ray sensitive detector means for receiving said fourth x-ray beam and directly generating therefrom an output corresponding to a two-dimensional second magnified image.

2. The system according to claim 1, further comprising:

monochromator means for monochromatizing said first x-ray beam prior to application thereof to said specimen.

3. The system according to claim 1, wherein:

said first x-ray beam is directed to be transmitted through said portion of said specimen to generate said second x-ray beam.

4. The system according to claim 1, wherein:

said first x-ray beam is directed to be reflected from said portion of said specimen to generate said second x-ray beam.

5. The system according to claim 1, further comprising:

data acquisition and processing means cooperating with said detector means to acquire and process said two-dimensional magnified image to generate data relating to said specimen therefrom.

6. The system according to claim 1, further comprising:

means for rotating said specimen through a predetermined angle; and means for digitizing and processing data generated by said detector means in relation to a rotation of said specimen to develop a three-dimensional magnified image of said specimen.

7. The system according to claim 1, further comprising:

disposition adjustment means for providing fine adjustments to the dispositions of said specimen relative to said first nearly perfect crystal, of said first nearly perfect crystal with respect to said second nearly perfect crystal, and of said second nearly perfect crystal relative to said detector means.

8. The system according to claim 7, wherein:

said adjustment means comprises means for controllably and independently adjusting in translation and in rotation the respective locations and orientations of said specimen, said first nearly perfect crystal, said second nearly perfect crystal and said detector means.

9. The system according to claim 8, further comprising:

computer means for controlling said adjustment means.

10. A system for obtaining a three-dimensionally magnified high-resolution image of a specimen, comprising:

means for applying a parallel first x-ray beam of predetermined energy and brilliance to a portion of the specimen, to thereby generate a parallel second x-ray beam which contains an initial image relating to the specimen;

a first nearly perfect crystal formed to provide a first diffraction surface oriented to receive said second x-ray beam at a first angle of incidence to dynamically diffract the same and to thereby generate a parallel third x-ray beam containing a first magnification of said initial image, said third x-ray beam being reflected with respect to said first diffraction surface at a first angle of reflectance relative thereto;

a second nearly perfect crystal formed to provide a second diffraction surface oriented orthogonally with respect to said first diffraction surface and disposed to receive said third x-ray beam at a second angle of incidence to dynamically diffract the same and to reflect a parallel fourth x-ray beam containing a second magnification of said first magnification in a direction orthogonal to a direction of said first magnification, said fourth x-ray beam being reflected with respect to said second diffraction surface at a second angle of reflectance relative thereto;

x-ray sensitive detector means for receiving said fourth x-ray beam and directly generating therefrom an output corresponding to a two-dimensional second magnified image;

monochromator means for monochromatizing said first x-ray beam prior to application thereof to said specimen;

disposition adjustment means for providing fine adjustments to the dispositions of said specimen relative to said first highly perfect crystal, of said first highly perfect crystal with respect to said second highly perfect crystal, and of said second highly perfect crystal relative to said detector means;

computer means for controlling said adjustment means;

means for rotating said specimen through a predetermined angle; and means for digitizing and processing data generated by said detector means in relation to a rotation of said specimen to develop a three-dimensional magnified image of said specimen.

11. A method for obtaining a two-dimensionally magnified high-resolution image of a specimen, comprising the steps of:

applying a parallel first x-ray beam of predetermined energy and brilliance to a portion of the specimen to generate a parallel second x-ay beam which contains an initial image relating to the specimen;

positioning a first highly-perfect crystal to orient a first diffraction surface thereof to receive said second x-ray beam at a first angle of incidence to dynamically diffract the same to generate a parallel third x-ray beam containing a first magnification of said initial image and reflecting said third x-ray beam with respect to said first diffraction surface and a first angle of reflectance relative thereto;

disposing a second nearly-perfect crystal to orient a second diffraction surface thereof orthogonally with respect to said first diffraction surface, said second diffraction surface being disposed to receive said third x-ray beam at a second angle of incidence to dynamically diffract the same and to reflect a parallel fourth x-ray beam containing a second magnification of said first magnification in a direction orthogonal to a direction of said first magnification, said fourth x-ray beam being reflected with respect to said second diffraction surface at a second angle of reflectance relative thereto; and receiving said fourth x-ray beam at an x-ray sensitive direct detecting means for generating therefrom an output corresponding to a two-dimensional second magnified image.

12. A method for obtaining a three-dimensionally magnified high-resolution image of a specimen, comprising the steps of:

applying a parallel first x-ray beam of predetermined energy and brilliance to a portion of the specimen to generate a parallel second x-ray beam which contains an initial image relating to the specimen;

positioning a first nearly perfect crystal to orient a first diffraction surface thereof to receive said second x-ray beam at a predetermined first angle of incidence to dynamically diffract the same to generate a parallel third x-ray beam containing a first magnification of said initial image and reflecting said third x-ray beam with respect to said first diffraction surface at a first angle of reflectance relative thereto;

disposing a second nearly perfect crystal to orient a second diffraction surface thereof orthogonally with respect to said first diffraction surface, said second diffraction surface being disposed to receive said third x-ray beam at a predetermined second angle of incidence to dynamically diffract the same and to reflect a parallel fourth x-ray beam containing a second magnification of said first magnification in a direction orthogonal to a direction of said first magnification, said fourth x-ray beam being reflected with respect to said second diffraction surface at a second angle of reflectance relative thereto;

receiving said fourth x-ray beam at an x-ray sensitive direct detecting means for generating therefrom data corresponding to a two-dimensional second magnified image; and rotating the specimen through a predetermined angle to thereby generated additional two-dimensional magnification data for processing into a three-dimensional image of the specimen.

* * * * *